US005137584A

United States Patent [19]

Jesseman

[11] Patent Number: 5,137,584

[45] Date of Patent: Aug. 11, 1992

[54] NIOBIUM CARBIDE STRENGTHENED STEEL FOR PORCELAIN ENAMELING

[75] Inventor: Rodney J. Jesseman, Middletown, Ohio

[73] Assignee: Armco Steel Company, L.P., Middletown, Ohio

[21] Appl. No.: 726,423

[22] Filed: Jul. 5, 1991

[51] Int. Cl.[5] ..... C21D 8/00; C23D 1/00; C23D 3/00

[52] U.S. Cl. ..... 148/537; 148/328; 148/603; 428/457

[58] Field of Search ..... 148/2, 12 C, 12 F, 328, 148/12.3

[56] References Cited

U.S. PATENT DOCUMENTS

| | | | |
|---|---|---|---|
| 2,264,355 | 12/1941 | Becket et al. | 148/31 |
| 3,183,078 | 5/1965 | Ohtake et al. | 75/49 |
| 3,333,987 | 8/1967 | Schrader et al. | 148/2 |
| 3,598,658 | 8/1971 | Matsukura et al. | 148/2 |
| 3,947,293 | 3/1976 | Takechi et al. | 148/12.3 |
| 3,988,173 | 10/1976 | Kawano | 148/12 C |
| 4,198,249 | 4/1980 | Roper, Jr. et al. | 148/36 |

FOREIGN PATENT DOCUMENTS

| | | | |
|---|---|---|---|
| 934275 | 9/1973 | Canada | 148/31 |
| 1101193 | 1/1968 | United Kingdom | 75/12.3 |

*Primary Examiner*—R. Dean
*Assistant Examiner*—Sikyin Ip
*Attorney, Agent, or Firm*—R. J. Buyard; L. A. Fillnow; R. H. Johnson

[57] ABSTRACT

Cold rolled, recrystallization annealed, high strength steel for porcelain enameling. The steel consists essentially of at least 0.005 wt. % niobium, at least 0.02 wt. % carbon, at least 0.10 wt. % manganese, at least 0.01 wt. % aluminum, nitrogen as an impurity, the ratio of acid sol. aluminum to total nitrogen being at least 2:1, all percentages by weight and the balance being iron and unavoidable impurities, whereby the annealed steel has a yield strength of at least 21 kg/mm$^2$ after being strained at least 8% and when heated to at least 815° C. The steel is produced by hot rolling a slab to a sheet having a finishing temperature at least $A_{r3}$, coiling the hot rolled sheet at a temperature at least 677° C. to precipitate residual nitrogen as aluminum nitride, removing scale from the hot rolled sheet, cold rolling the descaled sheet, annealing the cold rolled sheet without decarburization at a temperature less than 721° C. for sufficient time to avoid formation of iron carbides on the surfaces of the sheet and to precipitate the niobium as niobium carbide and temper rolling the annealed sheet. Niobium most preferably is in the range of 0.035–0.045 wt. %.

18 Claims, 5 Drawing Sheets

NIOBIUM CARBIDE STRENGTHENED STEEL FOR PORCELAIN ENAMELING

BACKGROUND OF THE INVENTION

This invention relates to low carbon, aluminum killed, cold rolled, recrystallization annealed steel. More particularly, the invention relates to a steel for porcelain enameling having niobium carbide precipitates for elevating yield strength to at least 21 kg/mm$^2$ after being strained at least 8% and heated to at least 815° C.

Steel sheets for household appliances such as ranges, dishwashers, cooktops, washers and dryers are formed into parts, cleaned to remove dirt and lubricants, specially treated by acid pickling to remove rust and scale and to deposit elemental nickel and then coated with a base coating of porcelain enamel. The as-coated parts are dryed and then heated at temperatures of about 760°-870° C. for fusing the enamel. Forming of the part can produce a strain of as much as 20% in the steel. During the heating, critical grain growth may occur in the steel part with a simultaneous loss of yield strength. This loss of yield strength requires thicker base metal to resist breakage by stresses imposed during service. It also allows flexure of the formed part during subsequent handling or use causing the enamel to chip off.

The prior art sought to avoid this loss of yield strength by adding elements such as niobium, titanium, zirconium, boron and vanadium which combine with carbon and/or nitrogen, or elements such as copper, silicon, chromium, phosphorus or manganese which strengthen by solid solution hardening. U.S. Pat. No. 3,183,078 discloses the addition of 0.005-0.035 wt. % aluminum and 0.05-0.20 wt. % titanium to a vacuum degassed melt having less than 0.02 wt. % carbon. After annealing, the steel is nonaging because soluble nitrogen and carbon are combined with aluminum and titanium as stable compounds. This steel is costly to manufacture and does not resist loss of yield strength during porcelain enameling. Canadian patent 934,275 discloses the addition of 0.02-0.06 wt. % niobium and 0.006-0.015 wt. % nitrogen to a steel melt containing at least 0.02 wt. % carbon and at least 0.10 wt. % manganese. The steel was hot rolled using a coiling temperature less than 677° C. and decarburized to less than 0.008% C during annealing. Total elongations of about 30% after annealing and yield strengths up to 398 MN/m$^2$ were disclosed after straining and heating. This steel is strengthened by precipitation of NbN during annealing. This steel can not be easily made by continuous casting and also is very costly to manufacture. U.S. Pat. No. 3,333,987 discloses adding less than a stoichiometric amount of one or more of the carbide forming elements of titanium, niobium or zirconium to a melt having at least 0.04 wt. % carbon. The steel is decarburized during annealing to remove any soluble carbon not combined with the carbide stabilizing element. Furthermore, a normalizing heat treatment is needed to develop suitable properties for forming parts. Yield strengths generally less than 21 kg/mm$^2$ are disclosed after straining and heating. U.S. Pat. No. 3,598,658 discloses an enameling steel containing 0.09 wt. % carbon, 0.19 wt. % manganese, 0.026 wt. % phosphorus, 0.04 wt. % copper, 0.03 wt. % vanadium, 0.04 wt. % chromium, 0.03 wt. % niobium and 0.05 wt. % titanium. The steel was decarburized to 0.003 wt. % carbon during annealing. High elevated temperature yield strengths are alleged.

As indicated above, many prior art workers have long attempted to develop cold rolled steels for porcelain enameling. However, they have been unsuccessful at developing an inexpensive high strength steel for porcelain enameling using conventional melting, hot rolling and annealing practices. Addition of precipitating hardening and/or nitride forming elements in stoichiometric quantity to a melt to produce high strength enameling steel is undesirable because of the added alloy cost. Vacuum decarburizing the liquid steel or special decarburizing annealing cycles to produce such a steel also are undesirable because of added processing time and cost. Vacuum decarburizing the liquid steel also is undesirable because the steel will not be fishscale resistant because insufficient iron carbide particles form in the steel during cooling after hot rolling. Accordingly, there remains a need for an inexpensive, high strength, recrystallization annealed steel for porcelain enameling. More particularly, there remains a need for such a steel produced using conventional processing.

BRIEF SUMMARY OF THE INVENTION

This invention is a cold rolled, recrystallization annealed steel for porcelain enameling and a method of producing. The steel consists essentially of least 0.005% niobium, at least 0.02% carbon, at least 0.10% manganese, at least 0.01% acid sol. aluminum, nitrogen as an impurity, the ratio of acid sol. aluminum to total nitrogen being at least 2:1, all percentages by weight and the balance being iron and unavoidable impurities, whereby the annealed steel has a yield strength of at least 21 kg/mm$^2$ after being strained at least 8% and heated to at least 815° C. The steel is produced by hot rolling a slab to a sheet having a finishing temperature at least $A_{r3}$, coiling the hot rolled sheet at a temperature at least 677° C. to precipitate residual nitrogen as aluminum nitride, removing scale from the hot rolled sheet, cold rolling the descaled sheet, annealing the cold rolled sheet without decarburization at a temperature less than 721° C. for sufficient time to avoid formation of iron carbides on the surfaces of the sheet and to precipitate niobium as niobium carbide and temper rolling the annealed sheet. Niobium preferably is at least 0.02 wt. %.

A principal object of the invention includes producing a cold rolled, annealed steel for porcelain enameling having a high yield strength after straining and heating.

Another object of the invention includes producing a high strength steel for porcelain enameling without hardening during hot rolling using melt alloying additions such as manganese, chromium, copper, phosphorus and silicon or intentional carbide and/or nitride strengthening during hot rolling using melt alloying additions such as vanadium and niobium.

Another object of the invention includes producing a high strength steel for porcelain enameling without decarburizing a melt or a sheet.

Another object of the invention includes producing a high strength steel having good enameling characteristics including resistance to enamel boiling during firing, resistance to sag or other plastic deformation during heating and resistance to fishscale.

Another object of the invention includes producing a high strength steel having good fishscale resistance because of iron carbides produced in the steel during cooling after hot rolling.

A feature of the invention includes a cold rolled, recrystallization annealed, temper rolled steel for porcelain enameling consisting essentially of at least 0.005% niobium, at least 0.02% carbon, at least 0.10% manganese, at least 0.01% aluminum, nitrogen as an impurity, the ratio of acid sol. aluminum to total nitrogen being at least 2:1, all percentages by weight and the balance being iron and unavoidable impurities, residual nitrogen in the annealed steel being present as aluminum nitride and niobium being present as niobium carbide whereby the steel has a yield strength of at least 21 kg/mm$^2$ after being strained at least 8% and heated to at least 815° C.

Another feature of the invention is a method of producing a cold rolled, recrystallization annealed steel for porcelain enameling with the steel consisting essentially of at least 0.005% niobium, at least 0.02% carbon, at least 0.10% manganese, at least 0.01% aluminum, nitrogen as an impurity, the ratio of acid sol. aluminum to total nitrogen being at least 2:1, all percentages by weight and the balance being iron and unavoidable impurities, including the steps of hot rolling a slab to a sheet having a finishing temperature at least $A_{r3}$, coiling the hot rolled sheet at a temperature at least 677° C. to precipitate residual nitrogen as aluminum nitride, removing scale from the hot rolled sheet, cold rolling the descaled sheet, annealing the cold rolled sheet without decarburization at a temperature less than 721° C. for sufficient time to avoid formation of iron carbides on the surfaces of the sheet and to precipitate niobium as niobium carbide and temper rolling the annealed sheet whereby the annealed steel has a yield strength of at least 21 kg/mm$^2$ after being strained at least 8% and heated to at least 815° C.

Advantages of the invention include producing a high strength steel for porcelain, enameling without requiring vacuum decarburization of a melt or without using stoichiometric melt alloying additions which can cause carbide and/or nitride hardening during hot rolling thereby reducing alloy cost. Another advantage of the invention includes producing a high strength steel for porcelain enameling having good resistance to enamel boiling during firing without using a special annealing cycle thereby saving processing time and energy cost. Another advantage of the invention includes a high strength steel for porcelain enameling having resistance to fishscale because of iron carbides produced during cooling after hot rolling.

The above and other objects, features and advantages of the invention will become apparent upon consideration of the detailed description.

DETAILED DESCRIPTION OF THE PREFERRED EMBODIMENT

Figure 1:
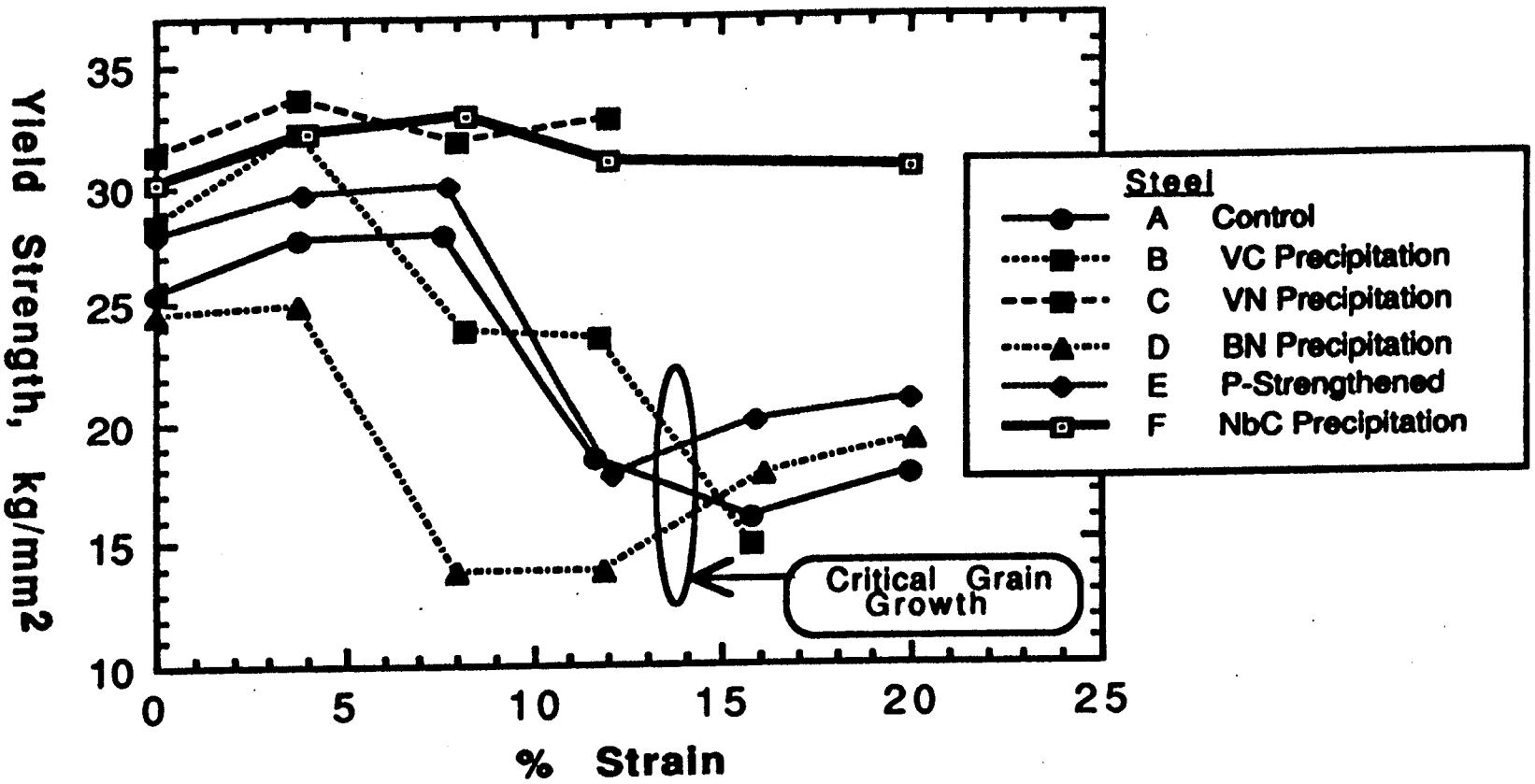
FIG. 1 is a graph of the yield strength of cold reduced, recrystallization annealed, temper rolled enameling steels A-F as a function of % strain after being heated at 871° C.

This invention is for high strength steel for porcelain enameling produced from a slab hot rolled to a sheet having a finishing temperature at least equal to the $A_{r3}$, coiling the hot rolled sheet at a temperature at least 677° C. to precipitate residual nitrogen as aluminum nitride, removing scale from the hot rolled sheet, cold rolling the descaled sheet, annealing the cold rolled sheet without decarburization at a temperature less than 721° C. for sufficient time to avoid formation of iron carbides on the surfaces of the sheet and to precipitate niobium as niobium carbide and temper rolling the sheet whereby the annealed sheet has a yield strength at least 21 kg/mm$^2$ after being strained at least 8% and heated to a temperature of 815° C. or more. For the steels of the invention, the $A_{r3}$ temperature generally will exceed 850° C.

The chemical composition of the steel in accordance with the present invention consists essentially of at least about 0.005 wt. % niobium, at least 0.02 wt. % carbon, at least 0.10 wt. % manganese, at least 0.01 wt. % aluminum, nitrogen as an impurity, the ratio of acid sol. aluminum to total nitrogen being at least 2:1, the balance being iron and unavoidable impurities.

An essential feature of the invention is the use of less than a stoichiometric quantity of niobium in the steel as a carbide former and the precipitation of substantially all niobium present in the steel as niobium carbide for retention of the yield strength after straining and heating at elevated temperature of as-enamel coated formed parts. At least 0.005 wt. % niobium is necessary to provide grain refinement during annealing and to retain a yield strength of at least 21 kg/mm$^2$ after straining at least 8% and heating at a temperature of at least 815° C. For parts requiring more than 8% strain during forming and/or heated at temperatures higher than 815° C., 0.02 wt. % or more niobium may be required to prevent critical grain growth and retain yield strength of at least 21 kg/mm$^2$. Niobium preferably should not exceed 0.06 wt. % because alloy cost is increased needlessly, hot rolling of the steel becomes more difficult, and total elongation after annealing and temper rolling is unnecessarily degraded. Accordingly, niobium more preferably is 0.02–0.06 wt. % and most preferably 0.035–0.045 wt. %.

The carbide former of the invention is niobium. Other known carbide formers such as titanium, boron and zirconium are excluded from the invention because they are ineffective for providing a yield strength of at least 21 kg/mm$^2$ after straining at least 8% and heating at a temperature of at least 815° C. Not being bound by theory, titanium, boron or zirconium apparently are ineffective because they preferentially combine with nitrogen before carbon and much of any titanium, boron and/or zirconium added to a steel melt precipitate as nitrides thereby providing minimal increase in yield strength after straining and heating.

Manganese should be at least 0.10 wt. % to prevent hot shortness due to sulfur during hot rolling and in no event be less than ten times the sulfur. Preferably, manganese should not exceed 0.40 wt. % because cost is increased unnecessarily and the austenite recrystallization temperature is elevated in steels containing niobium. Raising the austenite recrystallization temperature may prevent formation of a recrystallized structure before each rolling pass of a multistand finishing section during hot rolling. This increases power requirements during rolling, makes obtaining the correct thickness in the hot rolled steel more difficult, and the ferrite formed from the unrecrystallized austenite causes a cold rolled, annealed steel to have textures undesirable for deep drawing. A higher recrystallization annealing temperature may be required as well. Accordingly, a more preferred composition for manganese is 0.15–0.24 wt. %.

For an aluminum killed steel, at least 0.01 wt. % acid sol. aluminum is required to deoxidize the melt with the ratio of acid sol. aluminum to total nitrogen being at least 2:1. Hereinafter, it will be understood by aluminum is meant acid sol. aluminum. Maintaining this ratio insures that residual nitrogen in the steel is precipitated as aluminum nitride, both after hot rolling and after recrystallization annealing, rather than niobium nitride. A secondary reason for the aluminum is so that the recrystallization annealed steel is nonaging. For this reason, the aluminum preferably should be at least 0.02 wt. %. Aluminum preferably should not exceed 0.10 wt. % because cost is increased unnecessarily. More preferably, aluminum should be 0.02–0.08 wt. %.

Conventional residual amounts, i.e., impurities, of less than 0.01 wt. % total nitrogen, less than 0.02 wt. % phosphorus and less than 0.03 wt. % sulfur are acceptable.

As explained in more detail below, carbon should be at least 0.02 wt. % so that large carbides form in the steel during cooling after hot rolling to make the enameled steel fishscale resistant and to prevent dissolution of the niobium carbide particles during firing. On the other hand, excessive carbon may cause precipitation of niobium carbide during hot rolling thereby raising the austenite recrystallization temperature and resulting in similar problems to that described above during hot rolling when the steel contains high manganese. Excessive carbon also may cause formation of excessively large carbides on the sheet surfaces during batch annealing and may cause boiling during firing of ascoated enameled steel resulting in defects. For these reasons, carbon preferably should not exceed 0.08 wt. % and more preferably should not exceed 0.05 wt. %.

It will be understood by sheet is meant to include both cold rolled strip of indefinite length and cold rolled strip cut into definite lengths. It also will be understood the cold rolled sheets of the invention can be produced from slabs continuously cast from a melt or from ingots rolled on a slabbing mill. Preferably, the steel of the invention is produced from a melt continuously cast into slabs.

The steel is produced using inexpensive melt additions and hot rolled and annealed using conventional practices. A slab is rolled through a multistand rolling mill into hot rolled sheet. The hot rolled sheet is coiled, descaled, cold rolled, recrystallization annealed and temper rolled. The slab may be directly hot rolled either after continuous casting or after being slabbed from an ingot. Alternatively, the slab may be cooled prior to hot rolling in which case it would be necessary to reheat the slab prior to hot rolling. In either event, the slab should have sufficient starting temperature so that the hot rolled sheet when exiting the last finishing stand of the rolling mill has sufficient temperature to retain a fully austenite structure. A finishing temperature of at least 850° C., preferably at least 880° C., should be sufficient for this purpose. The hot rolled sheet is coiled at a temperature of at least 677° C., preferably at least 700° C., is descaled such as by pickling and is cold rolled at least 50%. The cold rolled sheet is recrystallization annealed such as batch annealing to a temperature less than $A_{r3}$, i.e., 721° C. and is temper rolled. The annealing temperature preferably is less than 700° C. and most preferably is about 677° C. The annealing temperature is controlled to less than $A_{r3}$ to substantially prevent the formation of large iron carbides on the surfaces of the sheet. By substantially no large iron carbides on the sheet surface is meant that no more than six such iron carbides will be visible at 500 magnification along a 25 mm length of a sheet surface when viewing a conventionally polished, picral etched sheet cross-section by optical microscopy. These carbides could cause boiling during firing of the as-coated enameled sheet resulting in surface defects.

When at least 0.02 wt. % carbon is present, use of an elevated coiling temperature following hot rolling causes carbon to precipitate as large iron carbides, i.e., cementite. Cementite is brittle and fractures during cold rolling producing subsurface voids in the sheet. These voids will be substantially retained after batch annealing. During heating of an as-enameled sheet, hydrogen created by the oxidation of iron by water vapor in the furnace atmosphere or in the enamel coating diffuses into the steel substrate. During subsequent cooling, hydrogen gas would otherwise diffuse from the steel substrate toward its surfaces thereby popping off the impermeable porcelain coating if the subsurface voids were not present. This phenomenon, known as "fishscaling", is prevented by using the elevated coiling temperature thereby providing "sites" or voids for the hydrogen gas to remain within the steel substrate.

Since substantially less than a stoichiometric amount of niobium is added to the melt of the invention, most of the carbon in the annealed sheet does not exist as niobium carbide but rather exists as "free" carbon. Accordingly, the steel of the present invention is useful for ground coat or ground coat plus cover coat enamel applications. Since the free carbon may cause boiling during enameling, the steel must be annealed below the lower critical temperature, i.e., 721° C., to prevent formation of large iron carbides on the sheet surfaces.

By way of example, low carbon, aluminum killed enameling steels were prepared in the laboratory. Steels A–L were cast into slab ingots and cooled to ambient. The slabs were reheated from ambient temperature to 126° C., were hot rolled into sheets having a thickness of 3.0 mm, had a finishing temperature of 900° C. and had a coiling temperature of 704° C. The hot rolled sheets then were descaled by pickling and cold reduced 67% to a thickness of 1.0 mm. The cold reduced sheets were heated at a rate of 28° C./hr (simulating batch annealing) to a temperature of 677° C., were soaked at this temperature for 4 hours and then temper rolled about 1%. After temper rolling, the sheets were strained various amounts and then heated to a temperature of 871° C. Steels G–L also were heated at a temperature of 816° C. as well. The compositions by weight percent are shown in Table 1 and mechanical properties of strained and heated sheets for steels A–L are shown in Table 2.

Steel A is a control sample containing no purposeful alloy addition for retaining yield strength after straining and heating. Steel B included a vanadium addition and steel C included vanadium and nitrogen additions for retaining yield strength after straining and heating. Steels D and E have boron and phosphorus additions, respectively, for retaining yield strength after straining and heating. Steel F of the invention included a niobium addition for retaining yield strength after straining and heating.

The yield strength for steels A–F is graphically illustrated in FIG. 1 as a function of % strain when heated to a temperature of 871° C. Only steels C and F did not have critical grain growth at strains of 16% or more and both demonstrated an ability to retain a high yield strength at these % strains.

Figure 2:
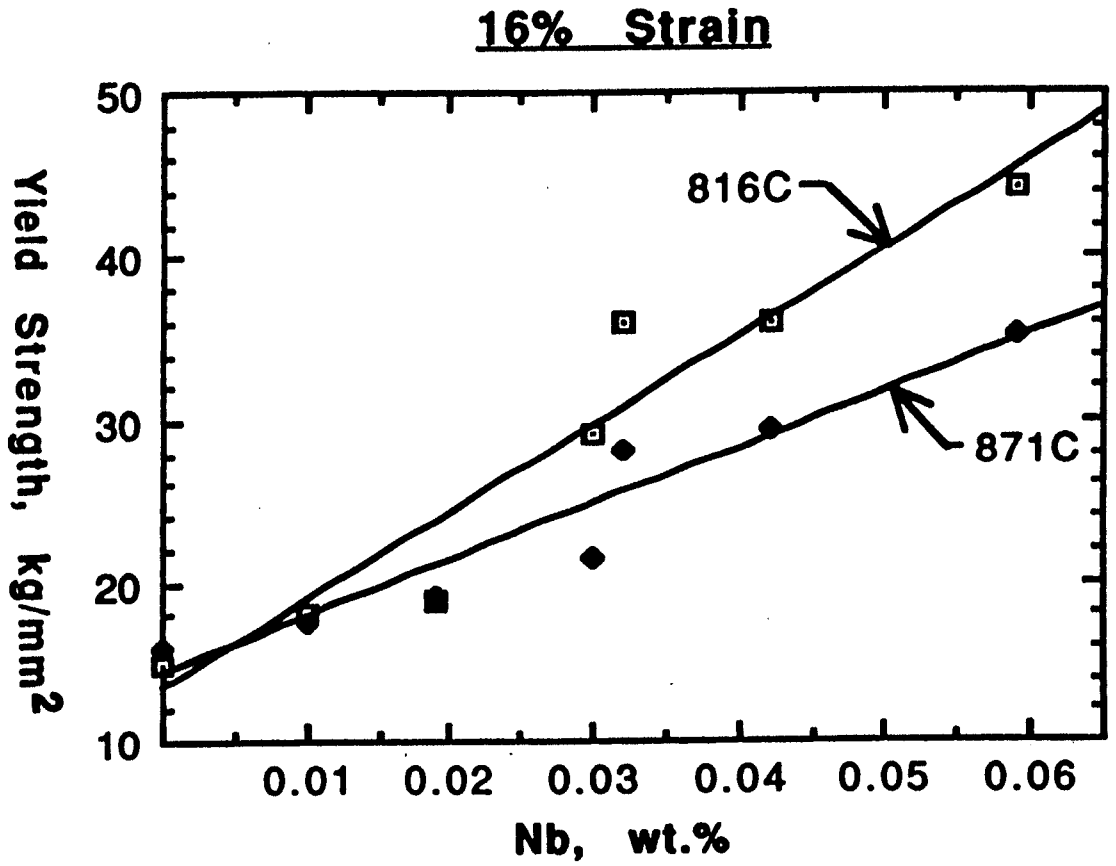
FIG. 2 is a graph of the yield strength of cold reduced, recrystallization annealed, temper rolled enameling steels G-L as a function of Nb after being strained 16% and heated at 816° C. or 871° C.
Figure 3:
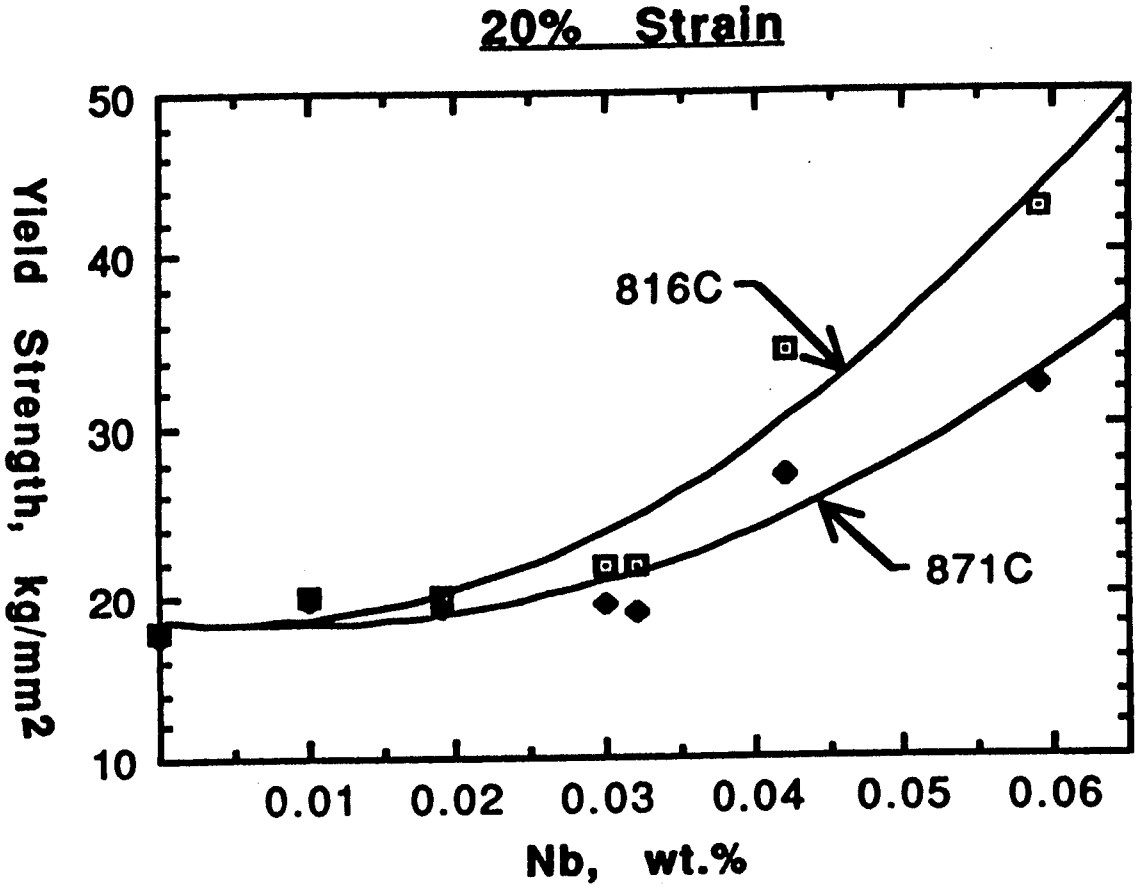
FIG. 3 is a graph of the yield strength of cold reduced, recrystallization annealed, temper rolled enameling steels G-L as a function of Nb after being strained 20% and heated at 816° C. or 871° C.

Steels G–L of the invention contain various amounts of niobium to determine its effect on retention of yield strength. Yield strength results for 16% and 20% strain are graphically illustrated in FIGS. 2 and 3, respectively, when heated to temperatures of 816° C. and 871° C. It is known that a yield strength of at least about 21 kg/mm$^2$ after drying and fusing of the enamel is desirable to achieve structural strength in the formed part and to eliminate damage to the porcelain enamel when handling or during subsequent use. FIGS. 2 and 3 both clearly demonstrate at least about 0.02 wt. % niobium is necessary to retain a yield strength of 21 kg/mm$^2$ or more at critical strain, i.e., 12% strain, and when the steel then is heated at an elevated enamel baking temperature of 816° C. or more.

TABLE 1

| STEEL | C | Si | N | Al | S | Mn | P | V | Nb | B |
|---|---|---|---|---|---|---|---|---|---|---|
| A | 0.046 | 0.011 | 0.004 | 0.043 | 0.008 | 0.22 | 0.005 | — | — | — |
| B | 0.048 | 0.011 | 0.004 | 0.043 | 0.009 | 0.22 | 0.004 | 0.042 | — | — |
| C | 0.046 | 0.001 | 0.014 | 0.012 | 0.009 | 0.25 | 0.006 | 0.044 | — | — |
| D | 0.043 | 0.003 | 0.004 | 0.048 | 0.009 | 0.22 | 0.006 | — | — | 0.0039 |
| E | 0.044 | 0.011 | 0.003 | 0.047 | 0.009 | 0.22 | 0.048 | — | — | — |
| F | 0.045 | 0.003 | 0.004 | 0.044 | 0.009 | 0.22 | 0.005 | — | 0.035 | — |
| G | 0.041 | 0.011 | 0.005 | 0.043 | 0.008 | 0.21 | 0.005 | — | 0.010 | — |
| H | 0.050 | 0.007 | 0.004 | 0.043 | 0.009 | 0.21 | 0.005 | — | 0.019 | — |
| I | 0.050 | 0.007 | 0.005 | 0.045 | 0.009 | 0.22 | 0.005 | — | 0.030 | — |
| J | 0.050 | 0.003 | 0.004 | 0.042 | 0.008 | 0.21 | 0.004 | — | 0.032 | — |
| K | 0.042 | 0.005 | 0.004 | 0.043 | 0.009 | 0.22 | 0.005 | — | 0.043 | — |
| L | 0.042 | 0.005 | 0.005 | 0.044 | 0.009 | 0.22 | 0.005 | — | 0.059 | — |

TABLE 2

| STEEL | % Strain | 0.2% Y.S.(kg/mm$^2$) | T.S.(kg/mm$^2$) | Healing Temp °C. | ASTM Grain Size No.* |
|---|---|---|---|---|---|
| A | 8 | 27.9 | 33.6 | 871 | 8.5 + band 1–3 @ surface |
| A | 12 | 18.4 | 30.7 | 871 | 3 & 8 |
| A | 16 | 15.9 | 31.1 | 871 | 3 & 8 |
| A | 20 | 17.7 | 31.2 | 871 | 3 & 8 |
| B | 8 | 23.8 | 32.6 | 871 | 8.5 + band 1–3 @ surfaces |
| B | 12 | 23.6 | 30.8 | 871 | 8.5 + band 1–3 @ surfaces |
| B | 16 | 14.8 | 30.4 | 871 | 3 |
| C | 8 | 32.0 | 38.3 | 871 | 8.5 |
| C | 12 | 32.8 | 38.5 | 871 | 8.5 |
| D | 8 | 13.9 | 29.0 | 871 | 1.5 & occas. 7.5 |
| D | 12 | 13.9 | 29.3 | 871 | 3 |
| D | 16 | 17.7 | 30.3 | 871 | 3.5 |
| D | 20 | 19.1 | 30.7 | 871 | 5 |
| E | 8 | 30.0 | 36.6 | 871 | 8.5 + band 1 @ surface |
| E | 12 | 17.7 | 33.5 | 871 | 3 & occas. 8 |
| E | 16 | 20.0 | 34.5 | 871 | 4 |
| E | 20 | 21.0 | 34.5 | 871 | 5 |
| F | 8 | 33.0 | 38.3 | 871 | 8.5 |
| F | 12 | 31.1 | 36.7 | 871 | 8.5 & occas. 1–6 @ surface |
| F | 20 | 30.7 | 36.4 | 871 | 8.5 & occas. 1–3 @ surface |
| G | 8 | 36.1 | 40.4 | 816 | 8.5 elong + occas. >> 1 @ surfaces |
| G | 12 | 16.9 | 30.9 | 816 | >1 |
| G | 16 | 17.9 | 32.6 | 816 | 1.5 |
| G | 21 | 20.0 | 33.4 | 816 | 2.5 |
| H | 8 | 37.1 | 41.4 | 816 | 9 elong. |
| H | 12 | 26.7 | 35.0 | 816 | 9 elong., >> 1 @ surfaces |
| H | 16 | 18.9 | 33.4 | 816 | >1 |
| H | 21 | 20.0 | 33.8 | 816 | 2.5 |
| I | 8 | 39.2 | 43.3 | 816 | 9 elong. |
| I | 12 | 40.8 | 44.7 | 816 | 8.5 elong. |
| I | 16 | 29.2 | 38.3 | 816 | 8.5 elong., >> 1 @ surfaces |
| I | 21 | 21.7 | 35.6 | 816 | >1 |
| J | 8 | 39.4 | 43.3 | 816 | 9 elong. |
| J | 12 | 40.5 | 44.0 | 816 | 8.5 elong. |
| J | 16 | 36.1 | 41.8 | 816 | 8.5 elong., >> 1 @ one surface |
| J | 20 | 21.8 | 35.6 | 816 | 2 |
| K | 8 | 39.7 | 44.0 | 816 | 9 elong. |
| K | 12 | 41.7 | 45.4 | 816 | 9 elong. |
| K | 16 | 36.1 | 42.1 | 816 | 8.5 elong. |
| K | 21 | 34.5 | 41.8 | 816 | 9 elong. + occas. > 1 @ surfaces |
| L | 8 | 41.6 | 46.1 | 816 | 9 elong. |
| L | 12 | 43.2 | 47.5 | 816 | 9 elong. |
| L | 16 | 44.2 | 48.8 | 816 | 8.5 elong. |
| L | 21 | 42.6 | 47.9 | 816 | 8.5 elong. |
| G | 8 | 26.6 | 34.1 | 871 | 8.5 + 1 or more @ surfaces |

TABLE 2-continued

| STEEL | % Strain | 0.2% Y.S.(kg/mm²) | T.S.(kg/mm²) | Healing Temp °C. | ASTM Grain Size No.* |
|---|---|---|---|---|---|
| G | 12 | 17.4 | 30.2 | 871 | >>1 |
| G | 16 | 17.6 | 31.5 | 871 | 1 |
| G | 22 | 19.6 | 32.6 | 871 | 2.5 |
| H | 8 | 28.9 | 36.7 | 871 | 8.5 + occas. 5 |
| H | 12 | 27.8 | 34.7 | 871 | 8 + > 1 @ surfaces |
| H | 16 | 19.1 | 31.9 | 871 | >1 |
| H | 21 | 19.2 | 32.8 | 871 | 2.5 |
| I | 8 | 32.7 | 38.4 | 871 | 8.5 |
| I | 12 | 30.0 | 36.8 | 871 | 8.5 + > 1 @ surfaces |
| I | 16 | 21.4 | 32.9 | 871 | 8.5 + occas. > 1 @ surfaces |
| I | 22 | 19.3 | 32.9 | 871 | 1.5 |
| J | 8 | 34.2 | 38.8 | 871 | 8.5 |
| J | 12 | 29.9 | 37.5 | 871 | 8.5 + occas. 1 @ surfaces |
| J | 16 | 28.2 | 35.1 | 871 | 8.5 + > 1 @ surfaces |
| J | 20 | 18.8 | 32.4 | 871 | >1 |
| K | 8 | 32.0 | 38.6 | 871 | 8.5 |
| K | 12 | 33.1 | 39.2 | 871 | 8.5 elong. + occas. 1 @ one surface |
| K | 16 | 29.5 | 36.1 | 871 | 8.5 elong. + occas. 1 @ surfaces |
| K | 21 | 27.2 | 36.1 | 871 | 8 + 2.5 @ surfaces |
| L | 8 | 34.4 | 40.6 | 871 | 8.5 elong. |
| L | 12 | 35.3 | 41.1 | 871 | 8.5 elong. |
| L | 16 | 35.2 | 40.9 | 871 | 8.5 elong. + occas. 1 @ surfaces |
| L | 21 | 32.3 | 39.0 | 871 | 8.5 elong. + occas. 1 @ surfaces |

*All grains were equiaxed unless otherwise indicated

Figure 4:
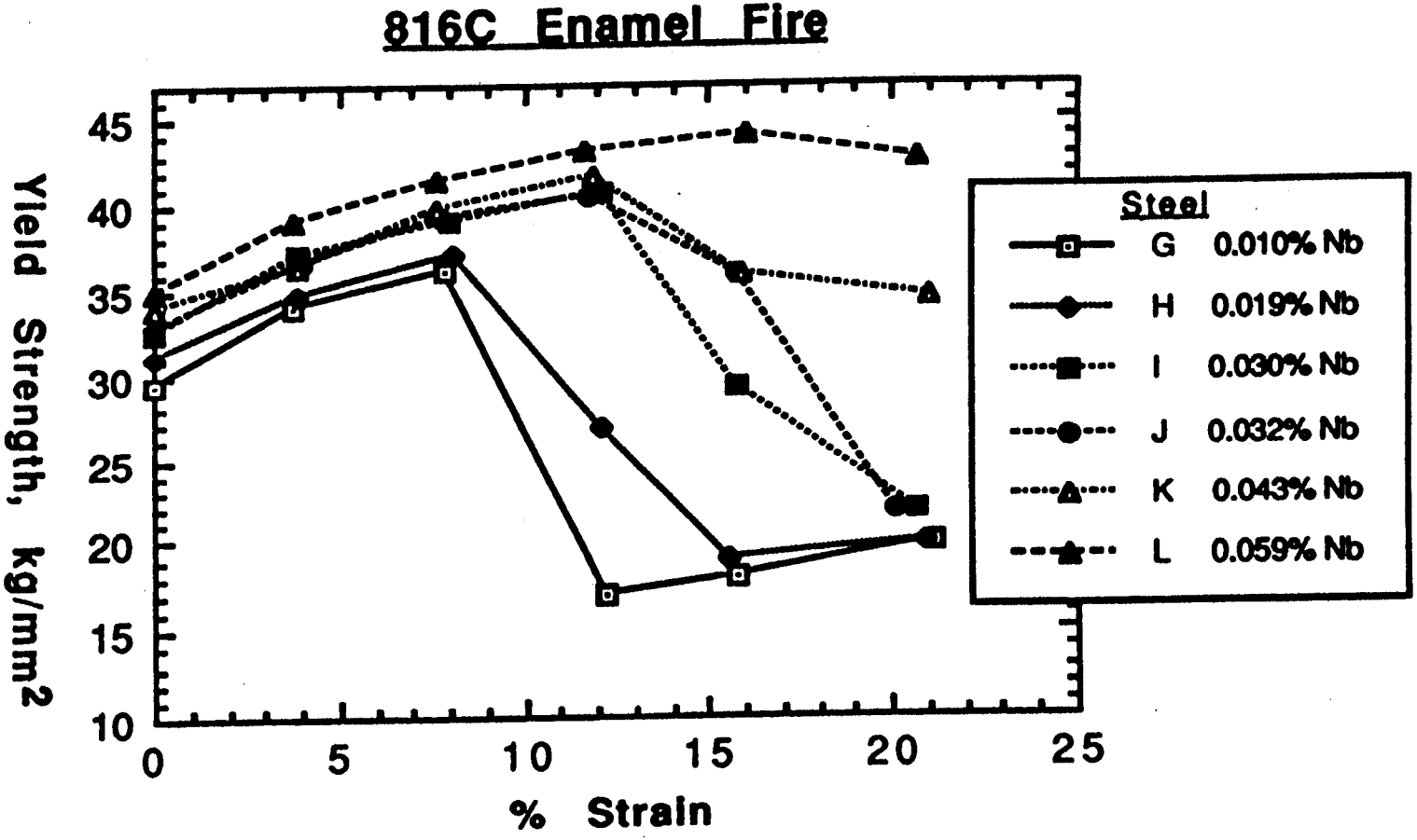
FIG. 4 is a graph of the yield strength of cold reduced, recrystallization annealed, temper rolled enameling steels G-L as a function of % strain and Nb after being heated at 816° C.
Figure 5:
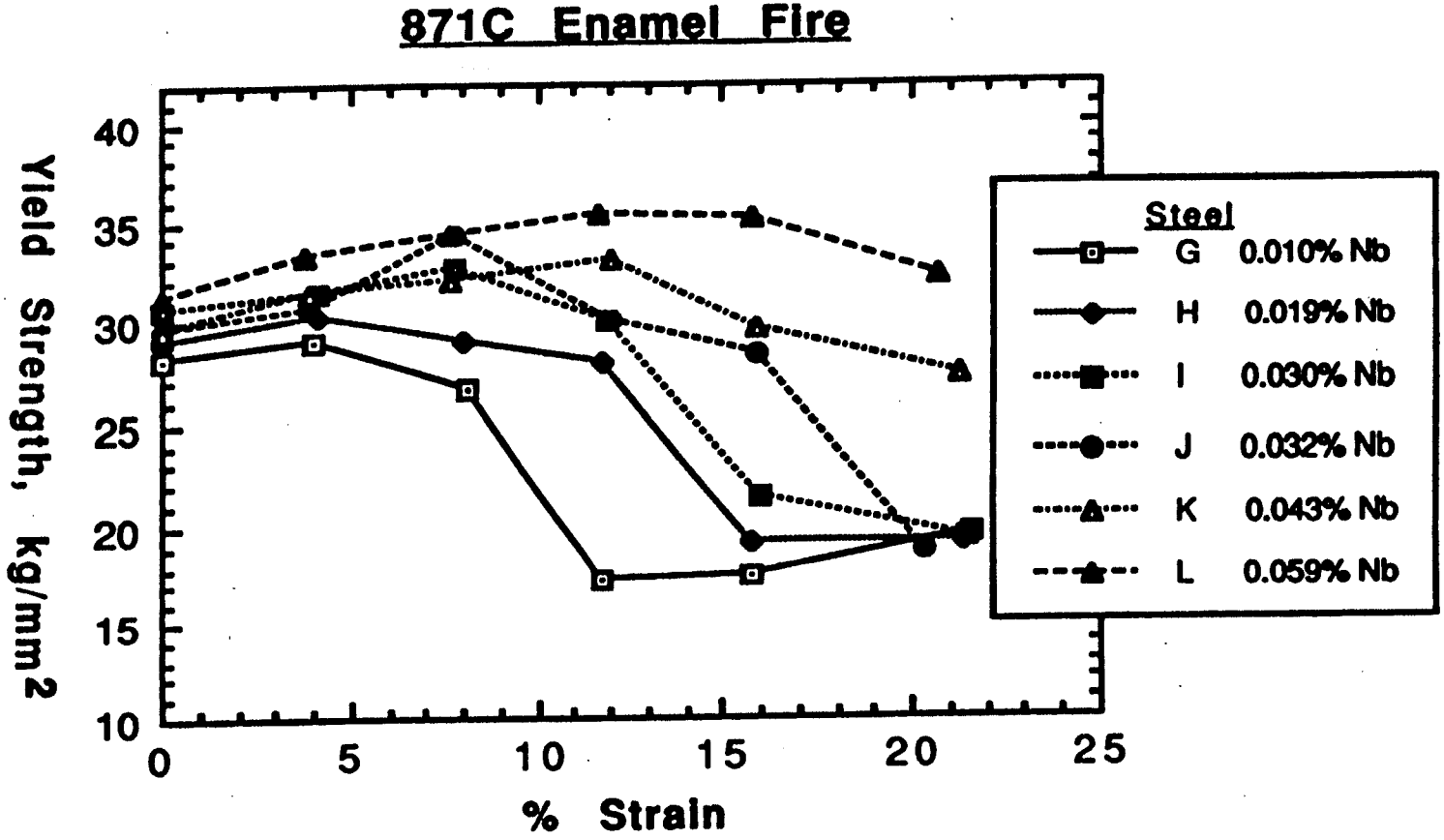
FIG. 5 is a graph of the yield strength of cold reduced, recrystallization annealed, temper rolled enameling steels G-L as a function of % strain and Nb after being heated at 871° C.

FIGS. 4 and 5 demonstrate a more detailed analysis wherein yield strength as a function of strain is graphically illustrated after the strained steels were heated to the temperatures of 816° C. and 871° C. FIG. 4 demonstrates critical strain begins at about 12%. For a minimum heating temperature of 816° C., at least about 0.02 wt. % niobium (steel H) is required for retention of about 21 kg/mm² yield strength after strains of about 16% or more. At a higher temperature of 871° C., even 0.035 wt. % niobium (steel J) was only marginally acceptable at 20% strain. To accommodate the worst case scenario within a appliance manufacturer's operation, a niobium composition approaching that of steel K (0.045 wt. %) is most preferred. The curve for steel K is almost horizontal demonstrating the amount of strain does not affect yield strength.

FIG. 4 clearly demonstrates the strengthening effect on yield strength at as little as 8% strain when a steel having as little as 0.010 wt. % Nb (steel G) was heated to a temperature of 816° C. For example, steel G had about 36 kg/mm² yield strength at 8% strain. This is important because a number of formed parts such as washing machine spinner baskets require improved structural strength with only 8-16% strain. For such applications, it will be understood niobium in amounts less than the above stated preferred amounts can be used.

It will be understood various modifications can be made to the invention without departing from the spirit and scope of it. Therefore, the limits of the invention should be determined from the appended claims.

What is claimed is:

1. A method of making porcelain enameled steel, comprising the steps of:

providing a slab consisting essentially of:

≧0.02 wt. % C,

≧0.10 wt. % Mn,

≧0.005 wt. % Nb,

≧0.01 wt. %Al,

N as an impurity, the ratio of said Al to said total N being at least 2:1, the balance being Fe and incidental impurities including said N, hot rolling said slab to a sheet having a finishing temperature ≧$A_{r3}$, coiling said hot rolled sheet at a temperature ≧677° C. to substantially precipitate said N as AlN, removing scale from said hot rolled sheet, cold rolling said descaled sheet, annealing said cold rolled sheet without decarburization at a temperature <721° C. for sufficient time to substantially avoid formation of iron carbides on the surfaces of said sheet and to precipitate said Nb as NbC, temper rolling said annealed sheet, straining said annealed sheet at least 8%.

coating said strained sheet with enamel, and heating said coated sheet to at least 815° C. to fuse the enamel.

whereby said enameled sheet has a yield strength ≧21 kg/mm².

2. The method of claim 1 wherein said Nb is ≧0.02 wt. %.

3. The method of claim 1 wherein said Nb is 0.035–0.045 wt. %.

4. The method of claim 1 wherein said Al is 0.02–0.08 wt. %.

5. The method of claim 1 wherein said Mn is 0.15–0.24 wt. %.

6. The method of claim 1 wherein said C is <0.08 wt. %.

7. The method of claim 1 wherein said coiling temperature is at least 700° C.

8. The method of claim 1 wherein said annealing temperature is at least 675° C.

9. The method of claim 1 wherein said finishing temperature is at least 870° C.

10. The method of claim 1 wherein said slab is continuously cast.

11. A method of making porcelain enameled steel, comprising the steps of:

providing a melt consisting essentially of:

0.02–0.08 wt. % C, 0.10–0.40 wt. % Mn, 0.02–0.06 wt. % Nb, 0.01–0.10 wt. % Al,

N as an impurity, the ratio of said Al to total said N being at least 2:1, the balance being Fe and incidental impurities including said N, casting said melt into a slab, hot rolling said slab to a sheet having a finishing temperature $\geqq A_{r3}$, coiling said hot rolled sheet at a temperature ≧677° C. to substantially precipitate said N as AIN, removing scale from said hot rolled sheet, cold rolling said descaled sheet, annealing said cold rolled sheet without decarburization at a temperature <721° C. for sufficient time to substantially avoid formation of iron carbides on the surfaces of said sheet and to precipitate said Nb as NbC, temper rolling said annealed sheet, straining said annealed sheet at least 12%, coating said strained sheet with enamel, and heating said coated sheet to at least 815° C. to fuse the enamel, whereby said enameled sheet has a yield strength ≧21 kg/mm$^2$.

12. A porcelain enameled steel, comprising:

an enameled steel having a yield strength ≧21 kg/mm$^2$ after having been strained at least 8% and heated to at least 815° C.

said steel having been produced from a cold rolled, recrystallization annealed, temper rolled sheet consisting essentially of:

≧0.02 wt. % C,

≧0.10 wt. % Mn,

≧0.005 wt. % Nb,

≧0.01 wt. % Al,

N as an impurity, the ratio of Al to total N being at least 2:1, the balance being Fe and incidental impurities including said N, said N being precipitated as AIN and said Nb being precipitated as NbC, the surfaces of said sheet being substantially free of iron carbides.

13. The steel of claim 12 wherein said Nb is ≧0.02 wt. %.

14. The steel of claim 12 wherein said Nb is 0.035–0.045 wt. %.

15. The steel of claim 12 wherein said Al is 0.02–0.08 wt. %.

16. The steel of claim 12 wherein said Mn is 0.15–0.24 wt. %.

17. The steel of claim 12 wherein said C is <0.08 wt. %.

18. A porcelain enameled steel, comprising:

an enameled steel having a yield strength ≧21 kg/mm$^2$ after having been strained at least 12% and heated to at least 815° C.

said steel having been produced from a cold rolled, recrystallization annealed, temper rolled sheet consisting essentially of:

0.02–0.08 wt. % C, 0.10–0.40 wt. % Mn, 0.02–0.06 wt. % Nb, 0.01–0.10 wt. % Al,

N as an impurity, the ratio of said Al to total said N being at least 2:1, the balance being Fe and incidental impurities including said N, said N being precipitated as AIN and said Nb being precipitated as NbC, the surfaces of said sheet being substantially free of iron carbides.

* * * * *